US012059049B2

(12) United States Patent
Kaplan

(10) Patent No.: US 12,059,049 B2
(45) Date of Patent: Aug. 13, 2024

(54) PROTECTIVE VISORED HELMET WITH DISINFECTED AIR FLOW PROPERTY

(71) Applicant: MALTEPE ÜNIVERSITESI TEKNOLOJI TRANSFER OFISI ANONIM SIRKETI, Istanbul (TR)

(72) Inventor: Askin Keskin Kaplan, Istanbul (TR)

( * ) Notice: Subject to any disclaimer, the term of this patent is extended or adjusted under 35 U.S.C. 154(b) by 47 days.

(21) Appl. No.: 17/625,279

(22) PCT Filed: Jun. 17, 2021

(86) PCT No.: PCT/TR2021/050615
§ 371 (c)(1),
(2) Date: Jan. 6, 2022

(87) PCT Pub. No.: WO2021/257038
PCT Pub. Date: Dec. 23, 2021

(65) Prior Publication Data

US 2022/0256961 A1 Aug. 18, 2022

(30) Foreign Application Priority Data

Jun. 17, 2020 (TR) ..... 2020/09416

(51) Int. Cl.
*A42B 3/22* (2006.01)
*A42B 3/28* (2006.01)

(52) U.S. Cl.
CPC ..... *A42B 3/22* (2013.01); *A42B 3/286* (2013.01)

(58) Field of Classification Search
CPC ..... A42B 3/22; A42B 3/225; A42B 3/281; A42B 3/286; A62B 7/10; A62B 18/003; A62B 18/006
See application file for complete search history.

(56) References Cited

U.S. PATENT DOCUMENTS 2,507,705 A * 5/1950 Gaddini ..... A62B 18/045 128/204.15
2,560,215 A * 7/1951 Christensen ..... A62B 18/003 128/200.28
3,736,927 A * 6/1973 Misaqi ..... A62B 18/006 128/201.25
4,430,995 A * 2/1984 Hilton ..... A62B 7/10 128/205.12
4,549,542 A * 10/1985 Chien ..... A62B 18/045 D24/110.2

(Continued)

FOREIGN PATENT DOCUMENTS

CN 2257730 Y 7/1997
CN 111249640 A 6/2020

(Continued)

OTHER PUBLICATIONS

International Search Report and Written Opinion of the International Searching Authority for corresponding PCT/TR2021/050615, dated Oct. 7, 2021.

*Primary Examiner* — F Griffin Hall
(74) *Attorney, Agent, or Firm* — Egbert, McDaniel & Swartz, PLLC

(57) ABSTRACT

A protective visored helmet with disinfected air flow property used in order to prevent infection (virus, bacteria, allergen) agents in cases of high contagion (during the treatment of viral/bacterial infections with high risk of airborne transmission, epidemics, pandemics).

2 Claims, 4 Drawing Sheets

(56) References Cited

Figure 1:
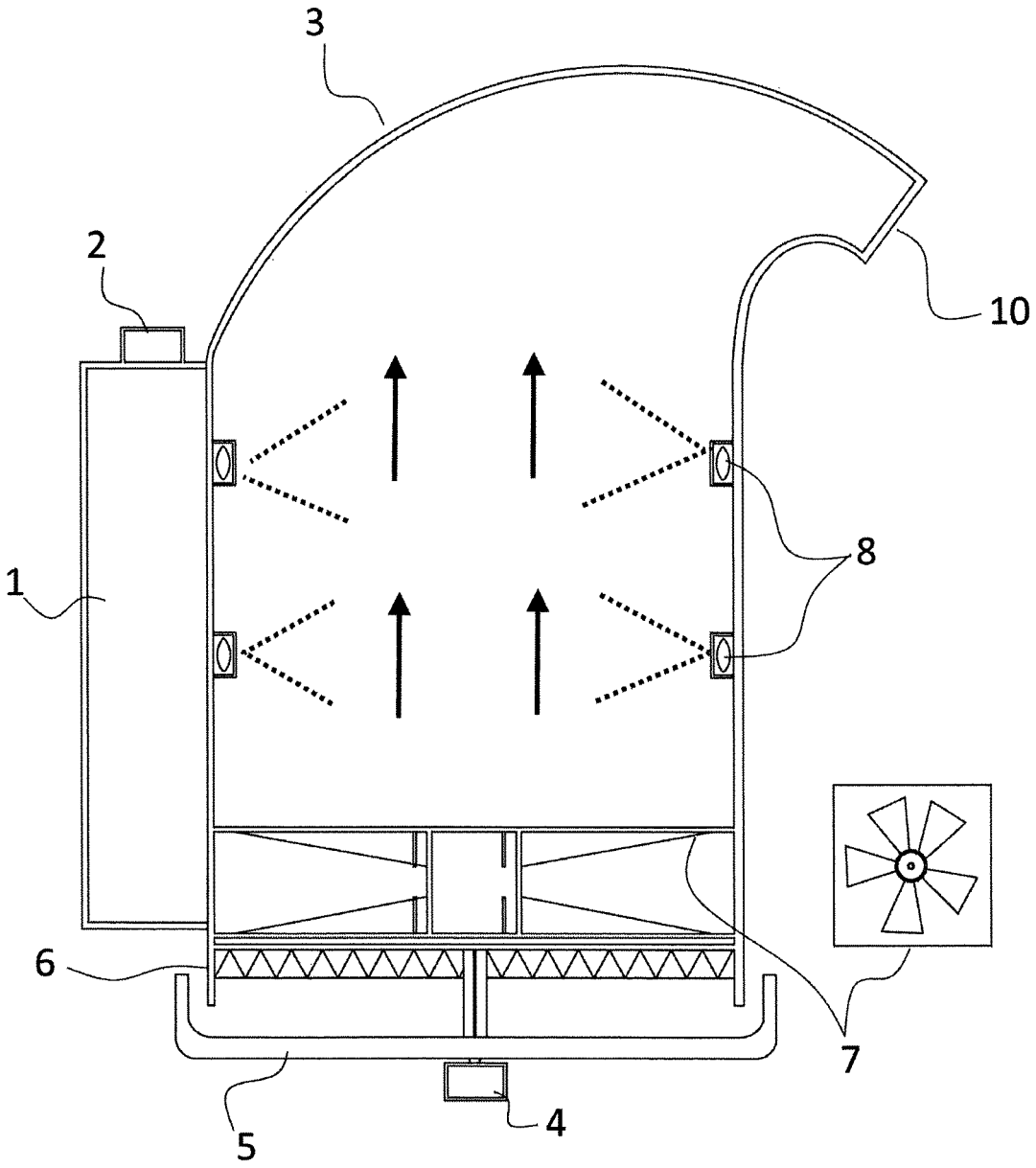

U.S. PATENT DOCUMENTS 4,590,951 A * 5/1986 O'Connor ..... A62B 18/006 128/205.12
4,899,740 A * 2/1990 Napolitano ..... F04D 25/08 128/205.12
5,022,900 A * 6/1991 Bar-Yona ..... A62B 18/006 55/DIG. 35
5,054,479 A * 10/1991 Yelland ..... A42B 3/286 2/9
5,104,430 A * 4/1992 Her-Mou ..... A62B 18/006 128/206.17
5,193,347 A * 3/1993 Apisdorf ..... A62B 17/005 62/259.3
5,394,870 A * 3/1995 Johansson ..... A62B 18/006 128/201.25
5,533,500 A * 7/1996 Her-Mou ..... A42B 3/288 128/205.12
5,577,496 A * 11/1996 Blackwood ..... A62B 18/006 128/204.23
5,655,374 A * 8/1997 Santilli ..... A41D 13/1218 2/905
5,878,742 A * 3/1999 Figueredo ..... A62B 18/003 128/201.24
5,906,203 A * 5/1999 Klockseth ..... A62B 18/006 128/205.12
6,014,971 A * 1/2000 Danisch ..... A62B 18/045 128/201.24
6,186,140 B1 * 2/2001 Hoague ..... B01D 46/0091 128/201.25
6,895,959 B2 * 5/2005 Lukas ..... A62B 18/006 128/201.24
7,118,608 B2 * 10/2006 Lovell ..... B01D 53/0415 55/DIG. 35
8,407,818 B2 * 4/2013 VanDerWoude ... A41D 13/1153 2/424
8,667,959 B2 * 3/2014 Tilley ..... A62B 18/006 128/205.12
8,667,960 B2 * 3/2014 Ausen ..... A62B 18/045 128/201.25
9,127,691 B2 * 9/2015 Hagen ..... F04D 25/084
9,358,409 B2 * 6/2016 Ausen ..... A62B 18/045
9,744,493 B2 * 8/2017 Legare ..... A62B 23/02
10,953,248 B2 * 3/2021 Yu ..... A61M 16/16
2005/0061316 A1 3/2005 Manne
2007/0283961 A1 * 12/2007 Hsieh ..... A62B 17/006 128/205.27
2009/0266361 A1 * 10/2009 Bilger ..... A62B 18/006 128/204.21
2015/0090254 A1 * 4/2015 Pavalarajan ..... A42B 3/286 128/201.23
2018/0084848 A1 * 3/2018 Pavalarajan ..... H04L 25/0272
2018/0311515 A1 * 11/2018 Wilson ..... A61B 5/6803
2021/0125468 A1 * 4/2021 Shuman ..... A62B 18/08

FOREIGN PATENT DOCUMENTS

CZ 20031908 A3 2/2005
TR 2020/07025 B 5/2020

* cited by examiner

PROTECTIVE VISORED HELMET WITH DISINFECTED AIR FLOW PROPERTY

TECHNICAL FIELD

The invention relates to a protective visored helmet with disinfected air flow property used in environments with high risk of droplet and/or airborne contamination.

The invention particularly relates to a protective visored helmet with disinfected air flow property used in order to prevent the infection (virus, bacteria, allergen) agents in cases of high contagion (during the treatment of viral/bacterial infections with high risk of airborne transmission, epidemics, pandemics).

STATE OF THE ART

Virus is basically spread directly with particles emitted from the breath (from their mouth, nose) of infected individuals, by hanging in the air, or by direct contact from contaminated surfaces. Therefore, to prevent direct contamination, keeping one's distance from other people at least one meter and from an individual who is coughing at least two meters or using personal protective material that provides complete insulation indoors prevents these particles from infected individuals, who are not infected from the virus, to a certain extend. The spread of the virus through droplets and/or airborne transmission is tried to be prevented by means of masks and/or visors.

Hospitals pose a significant risk, especially for healthcare professionals during the treatment of potential or infected patients. In this regard, in order to prevent droplet/airborne transmission of the virus such as the Covid-19 epidemic, healthcare professionals use protective clothes, surgical and special filtered masks (n95/ffp3), transparent glasses, visor, bonnet, and shoe covers. Healthcare professionals wear these protective clothes before treating each patient and discard disposable clothes afterward, and other protective materials are sent to the disinfection process for reuse.

These protective materials cannot fully cover the supraorbital zone, and during inhaling, the contaminated air in the room directly contacts the mask from the side facing the patient. The filtering effects of the masks currently used are insufficient, especially in cases where virus particles are extremely small (Corona Viruses 60-120 nm, 0.06-0.125 micron [1]).

Furthermore, contaminated droplets and virus particles can enter through the gaps left open by the transparent glasses and lead to the transmission of the disease thereof. In this regard, the visors and glasses used cannot provide complete protection due to the possibility of airflow in the contaminated room and from the side facing the patient.

Currently Used Personal Protection Equipment May Lead to Following Cases:

- Virus particles can hang in the air for a long time in the patient rooms as the ventilation systems in patient rooms are not designed to disinfect the room from viruses and disease factors.
- Masks used directly contacts with the contaminated airflow from the side facing the patient with a high-infection rate, limiting the protective effect of the masks.
- These masks can only be effective as long as they fully cover the individual's face; nevertheless, in most cases, there are gaps left on the sides of the face, increasing the risk of contamination thuswise. [1]

- Exposure time of the masks is limited depending upon the present contamination in the relevant environment. N95 or ffp3 type masks can be used longer than specified in their manuals. However, this situation reduces their reliability. [2]
- Glasses and visors pass in the highly contagious and risky air in the environment during inhaling and this contaminated air can pass through the glasses and hereby expose the eyes and open skin surfaces to virus contamination.
- Visors are only effective in droplet transmission cases, yet, particles hang in the air can freely enter through the gaps.
- Currently used personal protective materials work technically only for filtering and prevention with barrier function to prevent virus particles that cause contamination. However, these materials do not neutralize such contamination agents.
- Currently used methods and materials cannot provide adequate protection to healthcare professionals serving highly contagious patients (such as Covid19, etc.).

Patent application numbered TR2020/07025 was found in the literature during the research on the current technique. The application relates to a mask barrier that provides maximum protection against viruses, bacteria and allergens that may contaminate the body of the individual from his/her face, eyes, nose and mouth by ensuring that the mask and barrier are combined into one piece. Nevertheless, the said mask does not contain a disinfected and/or air flow embodiment.

As a result, due to the abovementioned disadvantages and the insufficiency of the current solutions regarding the subject matter, a development is required to be made in the relevant technical field.

THE OBJECTIVE OF THE INVENTION

The invention aims to solve the abovementioned disadvantages and deficiencies by being inspired from the current conditions.

The primary aim of the invention is to create an air curtain in front of the visor by means of a filtered and pathogen-free particle and pathogen-free air jet and/or stream, and to ensure that the contaminated that air suspended in the environment is not contacting with the mask and healthcare professionals.

The aim of the invention is to provide ambient air that is free from contaminated droplets and virus fragment, especially for healthcare professionals.

Another aim of the invention is to protect the eyes and other possible open skin surfaces (forehead, neck, etc.) from the contaminated air in the environment.

Another aim of the invention is to prevent the infection agents hanging in the air to contaminate the individual due to the insufficient surface covering of the mask, gaps in the vicinity of the supraorbital zone, and the reverse air flow around the visor.

Another aim of the invention is to increase the efficiency of the healthcare professionals by providing them with the high level of protection required in the treatment of the covid 19 infections, thus, ensuring a safe working environment.

In order to achieve the aforementioned objects, the invention is an air-flow protective visored helmet with disinfection properties that forms an air curtain around the face of the user in order to filter the air in the patient rooms or in an environment that is stipulated to have a contaminated air from pathogens and particles, characterized by comprising an air fan that draws the air in the environment, air chamber-1 that encloses the drawn air and changes the flow direction of the air by means of its curved surface, allowing large particles to subside/hit and adhere to the inlet cover/base, surface-1, a lubricated antiseptic layer that catches and neutralizes the big pathogens subsided to the bottom surface of the air chamber-1, HEPA filter that filters the particle-free air and vents the air in the air chamber-1, at least one led-1 located on the reflective wall of the air chamber-1 which disinfects the air from germs/viruses via UVC-radiation on the reflected air.

air chamber-2 that receives the disinfected air from the outlet port of the air chamber-1, and which consists of a curved variable diameter air channel that allows the air to accelerate towards the gravitational pull and decelerate in the opposite direction, surface-2, located on the base of the air chamber-2 that holds the small particles hang in the accelerated air by means of the deceleration in the expanding air channel after the 180-degree rotation of the air and via gravity, and which contains a disinfectant chemical on it, at least one led-2 located on the inner wall of the air channel which disinfects the air from germs/viruses via UVC-radiation on the reflected air, a pipe which delivers the disinfected particle-free air from the outlet port-2 of the air chamber-2 (11), to junction point-2, a supply channel located in the helmet which receives the air from the junction point-2 and distributes and transmits it, forming an air curtain thereof, air blow nozzle(s) (19) that transmit the air that became an air curtain to the visor (16) with a one-way flow.

The structural and characteristic features of the present invention will be understood clearly by the following drawings and the detailed description made with reference to these drawings and therefore the evaluation shall be made by taking these figures and the detailed description into consideration.

FIGURES FOR A BETTER UNDERSTANDING OF THE INVENTION

FIG. 1 a representative view of the 1st part of the inventive disinfected air flow protective visored helmet.

Figure 2:
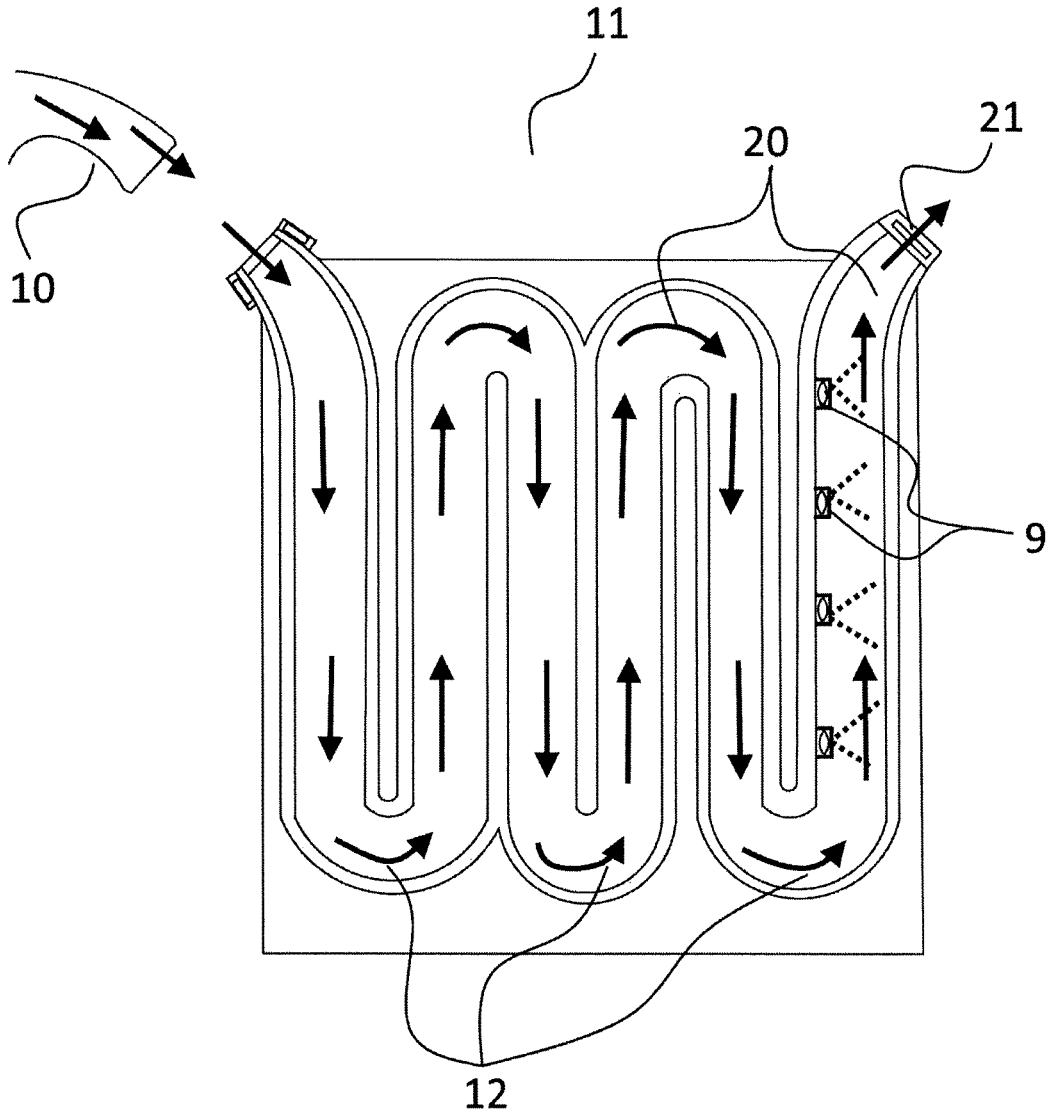

FIG. 2 a representative view of the 2nd part of the inventive disinfected air flow protective visored helmet.

Figure 3:
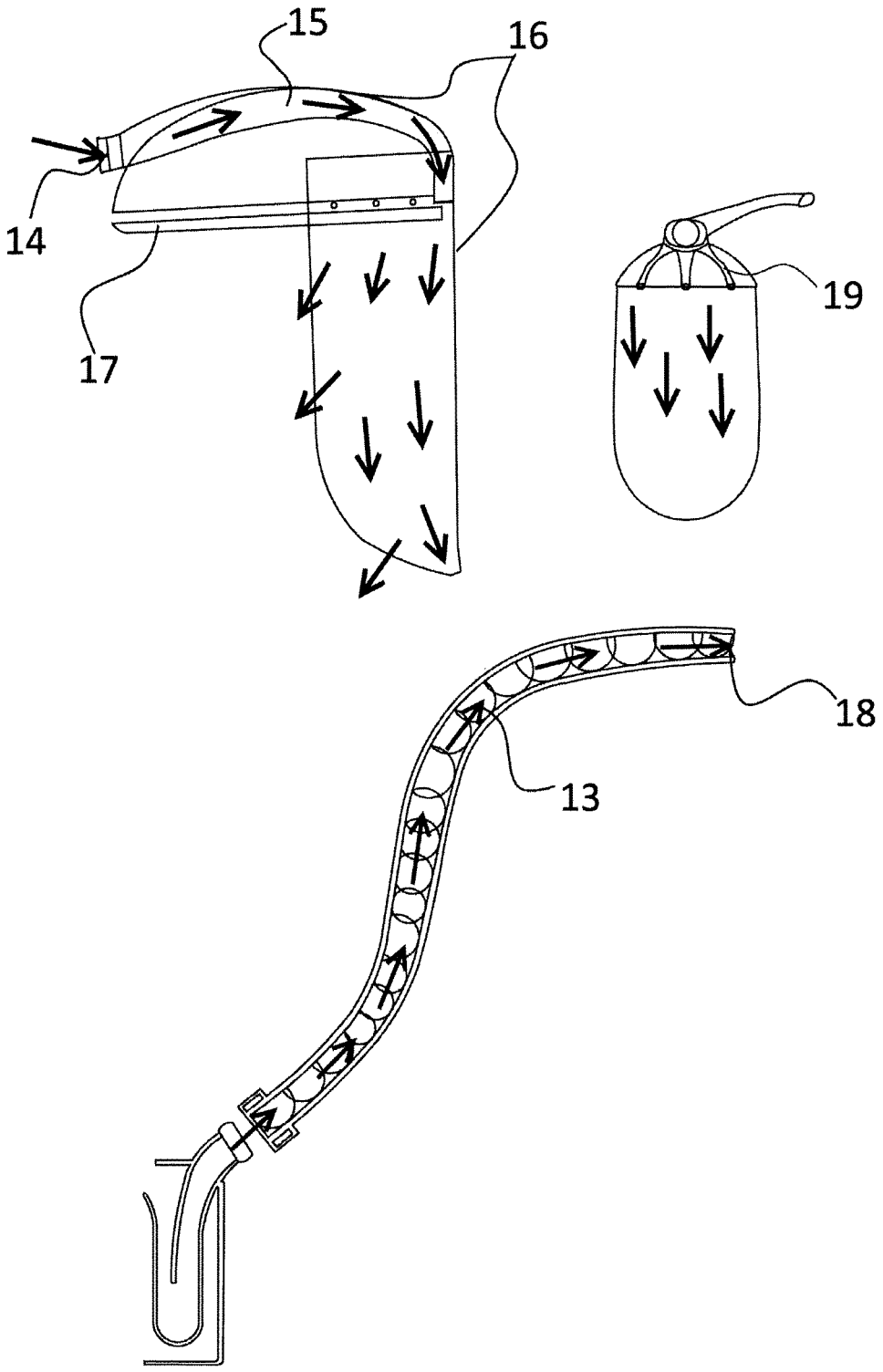

FIG. 3 a representative view of the 3rd part of the inventive disinfected air flow protective visored helmet.

Figure 4:
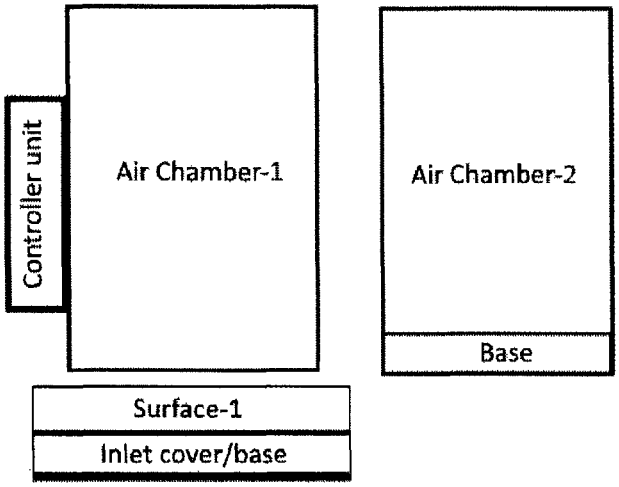

FIG. 4 is a block diagram of the disinfected air flow protective helmet of the present invention.

| List of the Reference Numbers |
|---|
| 1. Controller unit |
| 2. Control switches |
| 3. Air Chamber-1 |
| 4. Cover Screw |
| 5. Surface-1 |
| 6. HEPA Filter |
| 7. Air Fan |
| 8. Led-1 |
| 9. Led-2 |
| 10. Outlet port |
| 11. Air Chamber-2 |
| 12. Surface-2 |
| 13. Pipe |

-continued

| List of the Reference Numbers |
|---|
| 14. Junction point |
| 15. Supply canal |
| 16. Visor |
| 17. Helmet band |
| 18. Junction point-2 |
| 19. Air Blow nozzle |
| 20. Air Channel |
| 21. Outlet port-2 |

DETAILED DESCRIPTION OF THE INVENTION

In this detailed description, the preferred embodiments of the invention are merely described for a better understanding of the inventive protective visored (16) helmet with disinfected air flow property.

The inventive helmet filters the air in a patient room or in an environment that is stipulated to be contaminated from the pathogens and particles and forms an air curtain/flow around the face of the user, preventing the exposure to the contaminated air thereof.

The inventive helmet generally consists of 3 parts. FIG. 1, FIG. 2, FIG. 3 demonstrates the 1st, 2nd, and 3rd parts, successively; and the 1st and 2nd Parts are responsible for Filtering and disinfection processes, and the 3rd Part is responsible for isolation from the contaminated environment.

Firstly, air is drawn into the air chamber-1 (3) by means of the air fan (7). Air fan (7) is compatible with Li-Ion Battery or other battery types. Suction power of the air fan (7) is adjustable. This allows the control of the air velocity. The air sucked in the air chamber-1 (3) first encounters the 180-degree curved surface of the air chamber-1 (3). The air which encounters the curved surface ricochets and being filtered from its big particles by hitting the surface-1 (5) on the bottom surface of the air chamber-1 (3). Surface-1 (5) is a lubricated antiseptic layer that catches the particles filtered and neutralizes the pathogens.

The air filtered from big particles passes through the HEPA filter (6). The said HEPA filter (6) is a High Efficiency Particulate Arresting filter that retains the particles and droplets of 1 micron and above. The air passed through the hepa filter (6) is vented into the air chamber-1 (3).

Led-1 (8) is located on the inner reflective wall of the air chamber-1 (3). Led-1 (8) has UVC (Ultraviolet C) properties and provides UVC-radiation. The air entering the air chamber-1 (3) is disinfected against germs and viruses with the radiation provided by at least one Led-1 (8). The air flow radiated by the Led-1 (8) is accelerated and transmitted to the outlet port (10). Filtering and disinfection of the particles is provided by the change of air, gravity and air flow direction in the air chamber-1 (3). Outlet port (10) of the air chamber-1 (3) has an inclined and narrowing structure. By means of its structure, the air flow accelerates before the evacuation from air chamber-1 (3).

The accelerated air is then delivered to the air chamber-2 (11) from the outlet port (10) of the air chamber-1 (3). The air chamber-2 (11) consists of corrugated air channels (20). The air chamber-2 (11) provides variable air flow rate through the corrugated air channels (20). As seen in FIG. 2, corrugated structure of the air chamber-2 (11) and its adjustable diameter (U form) enable the air to rotate 180 degrees and after the rotation, the suspended particles accelerated by reducing the speed of the air to hit the U-formed base and walls (the air accelerates in the diameter channel, narrowing towards gravity and slightly decelerates in the channel expanding 180 degrees in the opposite direction.) In the meantime, the small particles hanged in the accelerated air adhere and hold on to the surface-2 (12) at the bottom of the air chamber-2 (11) by means of the gravity. The particles adhere on the surface-2 (12) thanks to its structural properties. The said surface-2 (12) has a lubricated or gel structure. Additionally, it contains disinfectant chemicals in its structure. This allows the neutralization of the pathogens.

The flow rate of the air in the air chamber-1 (3) and air chamber-2 (11) can be adjusted and controlled by the controller unit (1). Controller unit (1) enables the opening and closing of the system. The necessary controls and adjustments can also be performed via the mobile application to be installed on the mobile device. Battery status of the invention, remaining charge, led-1 (8) and led-2 (9) can also be controlled through the controller unit (1). Additionally, the air flow rate can be controlled via control switches (2).

The flow of air in the air chamber-2 (11) rotates in the air channels (20) at least 3 times by means of the controller unit (1). The air inside the air chamber-2 (11) is exposed to UVC-radiation by at least one led-2 (9) located on the inner wall of the air channel (20) before arriving the outlet port-2 (21). Led-2 (9) has UVC (Ultraviolet C) properties and provides UVC-radiation. The air is disinfected by means of UVC-radiation under the led-2 (9). UVC-radiated air is transmitted to outlet port-2 (21). Disinfected and particle-free air is transmitted to the pipe (13) through outlet port-2 (21). Inner wall of the pipe (13) has a smooth, soft and kink-prevented structure. The air passed through the pipe (13) is transmitted to the junction point (14). The junction point (14) transfers the filtered clean air to the junction point-2 (18).

Air transferred to the junction point-2 (18) is then delivered to at least one supply canal (15) located in the helmet. The supply canal (15) provides the distribution and transmission of the air, forming an air curtain thuswise. The air is then transferred to the visor (16) by means of air blow nozzle(s) (19). The air blow nozzle (19) provides the formation of air curtain and the air flow ensures one-way air release. The air blow nozzle(s) (19) also prevents fogging on the goggles with its one-way air flow in cases when protective glasses are worn and filters the inhaled air thuswise. The air conveyed to the veiled visor (16) is collected clean and pathogen-free. Visor (16) structure ensures the clean air to form an air curtain in the visor (16).

The inventive protective visored (16) helmet with disinfected air flow property is used by means of an adjustable helmet band (17).

The HEPA filter (6) can be changed by opening the cover screw (4), which can be manually opened, located at the bottom of the air chamber-1 (3).

The invention claimed is:

1. An air flow protective visored helmet configured to form a disinfected air flow curtain around a face of a user so as to filter air in an environment contaminated with pathogens or particles, the air flow protective visored helmet comprising:

an air fan adapted to draw air from the environment;

a first air chamber adapted to enclose air drawn from said air fan, said first air chamber having a curved surface that changes a direction of the air, said first air chamber having an inlet cover or base adapted to allow particles to subside or hit and adhere thereto;

a first surface being a lubricated antiseptic layer adapted to catch and neutralize pathogens that have subsided to a bottom surface of said first air chamber;

a HEPA filter cooperative with said first air chamber so as to filter air in said first air chamber and to vent the air from said first air chamber;

at least one first LED positioned on a reflective wall of said first air chamber, said at least one first LED adapted to disinfect germs or viruses from air reflected from the reflective wall, said at least one first LED emitting UVC radiation;

a second air chamber adapted to receive air from an outlet port of said first air chamber, said second air chamber having a curved variable diameter air channel that allows air to accelerate toward a gravitational pull in one direction and to decelerate in an opposite direction;

a second surface formed on a U-shaped base of said second air chamber, said second surface adapted to allow air to accelerate by passing through the curved variable diameter air channel and to rotate 180° with respect to the curved variable diameter air channel after passing through the U-shaped base so as to hold small panicles suspended by gravity in the air that is slowed down thereby, said second surface having a disinfectant chemical thereon;

at least one second LED positioned on an inner wall of the curved variable diameter air channel, said at least one second LED adapted to disinfect germs or viruses via UVC radiation on the reflected air;

a pipe connected to an outlet port of said second air chamber so as to deliver disinfected particle-free air from the outlet port of said second air chamber to a junction port;

a supply channel communicating with the junction port and adapted to pass the air from the junction port to the air flow protective visored helmet in order to form the air flow curtain; and an air blow nozzle cooperative with the air flow protective visored helmet and adapted to transmit the air unidirectionally from the air flow curtain in the air flow protective visored helmet.

2. The air flow protective visored helmet of claim 1, further comprising:

a controller unit cooperative with said first air chamber and said second air chamber so as to change a flow rate of the air therein.

* * * * *